US006398361B1

(12) United States Patent
Hayashi

(10) Patent No.: US 6,398,361 B1
(45) Date of Patent: Jun. 4, 2002

(54) IMAGE PRINTING MEDIUM AND PRINTER

(75) Inventor: Junji Hayashi, Saitama-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 41 days.

(21) Appl. No.: 09/602,885

(22) Filed: Jun. 23, 2000

(30) Foreign Application Priority Data

Jul. 7, 1999 (JP) ..... 11-193199

(51) Int. Cl.[7] ..... B41J 2/01
(52) U.S. Cl. ..... 347/107; 347/105; 101/483
(58) Field of Search ..... 347/101, 107, 347/104, 105; 400/621, 621.1; 101/483; 493/355; 283/105; 83/361, 860, 801; 346/50, 78, 141

(56) References Cited

U.S. PATENT DOCUMENTS 5,572,291 A * 11/1996 Moriguchi et al. ..... 399/390
5,682,039 A * 10/1997 Lawrence et al. ..... 250/599 A
6,095,919 A * 8/2000 Fabel ..... 462/25
6,208,429 B1 * 3/2001 Anderson ..... 358/1.18

FOREIGN PATENT DOCUMENTS

JP 9-323484 12/1997 ..... B41M/5/38

* cited by examiner

*Primary Examiner*—John Barlow
*Assistant Examiner*—Alfred Dudding
(74) *Attorney, Agent, or Firm*—Sughrue Mion, PLLC

(57) ABSTRACT

An image printing medium having a position detection marker which without a need for printing during a manufacturing process and without generating waste. The position detection marker, whose relative position relationships with image printing regions is determined in advance, is cut in a multicolor heat-sensitive recording sheet at a seal side thereof. The position detection marker is formed by being cut in a seal from a surface of the seal to a boundary surface between the seal and peel-off paper, or from the surface of the seal to an arbitrary depth of the multicolor heat-sensitive recording sheet such that transmittance or reflectance of light transmitted through or reflected from the position detection marker is different from other portions of the multicolor heat-sensitive recording sheet than at the position detection marker.

28 Claims, 7 Drawing Sheets

SEAL PAPER HAVING FOUR DIVISIONAL PORTIONS
(AS SEEN FROM PEELING-OFF PAPER SIDE)

SEAL PAPER HAVING FOUR DIVISIONAL PORTIONS
(AS SEEN FROM IMAGE PRINTING REGION SIDE)

IMAGE PRINTING MEDIUM AND PRINTER

BACKGROUND OF THE INVENTION

1. Field of the Invention

The present invention relates to an image printing medium, and more specifically, to an image printing medium which has a position detection marker for detecting an image printing region.

2. Description of the Related Art

Conventionally, in a case in which an image is printed on an image printing medium in which image printing regions are defined, an image is printed after detection of the image printing regions by using a sensor. Generally, in a method of detecting the image printing regions by a sensor, a mark for position detection (referred to a "position detection marker" hereinafter), whose relative positional relationships with respect to the image printing regions are determined, is marked in advance on the image printing medium. This position detection marker is detected by the sensor so that the image printing regions are determined.

As position detection markers, a rectangular mark 50 which is printed on a reverse surface of an image printing medium (see FIG. 7A) and a rectangular hole 52 which is punched outside of the image printing regions (see FIG. 7B) are known (see Japanese Patent Application Laid-Open (JP-A) No. 9-323484).

However, in order to print the position detection marker on the reverse surface of the image printing medium, during a manufacturing process of the image printing medium, another process exclusively for printing the position detection marker becomes necessary.

In a case in which a printing process is involved in the manufacturing process of the image printing medium, for example, when a box for a stamp is printed on the reverse surface of the image printing medium in the case of printing post cards, the position detection marker may be printed on the image printing medium at the same time as the box for the stamp is printed.

On the other hand, in a case in which no printing process is involved in the manufacturing process of the image printing medium, for example, in a case in which the image printing medium is a sealing paper, because there is no printing process, there is the inconvenience that a printing process exclusively for printing the position detection marker becomes necessary.

Further, in a case in which the position detection marker is formed by punching a hole in the image printing medium, a drawback is caused in that waste material is generated by the punching, thus requiring a measure during the manufacturing process for handling the generated waste. Moreover, in a case of using an image printing medium wound in a roll, such as, in particular, a multicolor heat-sensitive recording sheet (i.e., thermo-auto-graphic paper), there has been the drawback that, when the multicolor heat-sensitive recording sheet is left in an illuminated place, portions of the multicolor heat-sensitive recording sheet overlapping the punched holes are exposed.

SUMMARY OF THE INVENTION

In view of the aforementioned facts, it is an object of the present invention to provide an image printing medium having a position detection marker which can be formed without the need for a printing process during a manufacturing process and without generating waste.

In order to solve these problems, in accordance with a first aspect of the present invention, there is provided an image printing medium comprising: (a) at least one image printing region; and (b) at least one position detection marker for use in detecting position of the image printing region relative to the position detection marker, wherein the position detection marker is formed by cutting.

Here,"cutting" means cutting in a predetermined configuration from the surface of the image printing medium to a predetermined depth thereof. In cases in which cuts are formed so as to penetrate the image printing medium as well as cases in which cuts are formed so as not to penetrate the image printing medium so as to allow an arbitrary thickness of the image printing medium to remain, a portion formed by this cutting is a cut piece which does not separate from the image printing medium.

In accordance with the present invention, since the position detection marker is formed by cutting, the position detection marker can be formed without a printing process. Further, in the cutting process, since the position detection marker is formed only by cutting and no through holes are formed in the image printing medium, generation of waste can be prevented. Accordingly, there is no need to take measures for preventing waste in the process of forming the position detection marker. In the present invention, the image printing medium is preferably cut to a partial depth thereof so as to prevent the cut piece from separating from the image printing medium.

The image printing region or regions can be formed by cutting. Further, the position detection marker can be formed at the same time as the time when the image printing region is cut. If both the image printing region and the position detection marker are formed by cutting, the position detection marker can be formed at the same time that the image printing region is cut. As a result, the position detection marker can be formed more easily.

The image printing medium may be a sheet member whose one side is tacky and is adhered to a peel-off paper. In this case, even when the image printing medium is completely cut, the cut portion remains adhered to the peel-off paper.

At least one of the cut shape, the size, the number, and the position of the position detection marker may differ the type of the image printing medium or the number of image printing region.

In accordance with a second aspect of the present invention, there is provided a multicolor heat-sensitive recording sheet comprising: (a) at least one image printing region; and (b) at least one position detection marker for use in detecting position of the image printing region relative to the position detection marker, wherein the position detection marker is formed by cutting.

In accordance with a third aspect of the present invention, there is provided a printer for printing an image on an image printing medium, the image printing medium having an image printing region and a position detection marker for detecting position of the image printing region relative to the position detection marker, the image printing region and position detection marker being defined by cuts, the printer comprising: (a) a sensor which detects the position detection marker on the image printing medium; and (b) an image printing member which prints an image on the image printing region at a time synchronized with when the position marker is detected, wherein the image printing medium is conveyed to the image printing member for printing an image on the image printing medium.

DESCRIPTION OF THE PREFERRED EMBODIMENTS

With reference to the drawings, a description of an embodiment of the present invention will be given hereinafter.

Figure 1A:
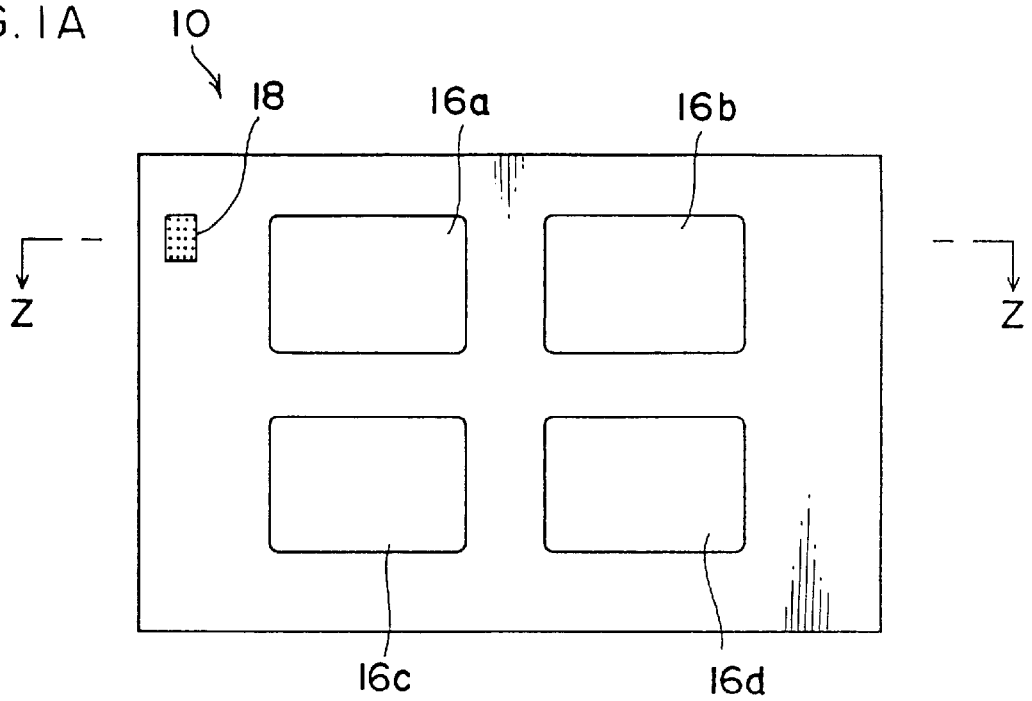
FIG. 1A is a schematic front view of a multicolor heat-sensitive recording sheet in accordance with an embodiment of the present invention.
Figure 1B:
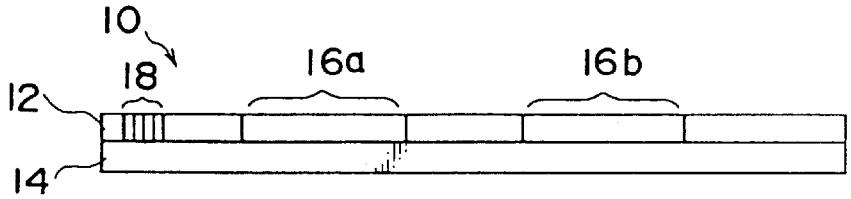
FIG. 1B is a cross-sectional view taken along a line Z—Z of FIG. 1A.

As is shown in FIG. 1B, a multicolor heat-sensitive recording sheet 10 in accordance with the present embodiment is structured in a state in which a seal 12, which is an image printing medium and has adhesiveness and to whose rear surface pasted is applied, and a peel-off paper 14 are adhered to each other.

As is shown in FIG. 1A, image printing regions 16*a*, 16*b*, 16*c*, and 16*d* which are defined by cutting are formed on the multicolor heat-sensitive recording sheet 10 at the seal 12 side thereof. These image printing regions 16*a* to 16*d* are formed by cutting from the surface of the seal 12 to the boundary surface between the seal 12 and the peel-off paper 14.

The peripheral portion of each of the image printing regions 16*a* to 16*d* does not have to be completely cut. In order to prevent peeling-off of the image printing regions 16*a* to 16*d* from the multicolor heat-sensitive recording sheet 10, the periphery of each image printing region can be cut partially, namely, the boundary of the image printing region can be perforated by making a series of spaced apart cuts and/or the periphery can be cut halfway down in the depthwise direction of the multicolor heat-sensitive recording sheet 10.

A position detection marker 18 is cut in the multicolor heat-sensitive recording sheet 10 at the seal 12 side thereof, at a position where a positional relationship between the position detection marker 18 and the image printing regions 16*a* to 16*d* is previously determined. The position detection marker 18 is also structured by a cutting in the same manner as the image printing regions 16*a* to 16*d*.

However, the position detection marker 18 is not necessarily cut from the surface of the seal 12 to the boundary surface between the seal 12 and the peel-off paper 14, and instead, may be structured by being cut from the surface of the seal 12 to an arbitrary depth of the multicolor heat-sensitive recording sheet 10 such that transmittances or reflectances of light transmitted to or reflected from the position detection marker 18 are different from other portions of the multicolor heat-sensitive recording sheet 10 than the position detection marker 18.

Figure 1C:
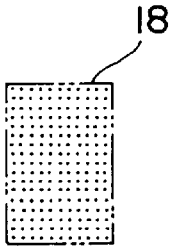
FIG. 1C is an enlarged view of a position detection marker.

Further, the position detection marker 18 can be cut so as to reach the surface of the peel-off paper 14, and unless the position detection marker 18 is separated from the seal 12, it can be cut so as to penetrate the peel-off paper 14. As is shown in FIG. 1C, the position detection marker 18 is perforated so as to form a striped configuration.

A configuration of the position detection marker 18 must be determined in accordance with properties of paper for structuring the seal 12, such as thickness and strength. However, as is shown in FIGS. 3A to 3D, the position detection marker 18 may be formed into a configuration such that transmittances or reflectances of light transmitted to or reflected from the position detection marker 18 is different from other portions of the multicolor heat-sensitive recording sheet 10 than the position detection marker 18.

Figure 3A:
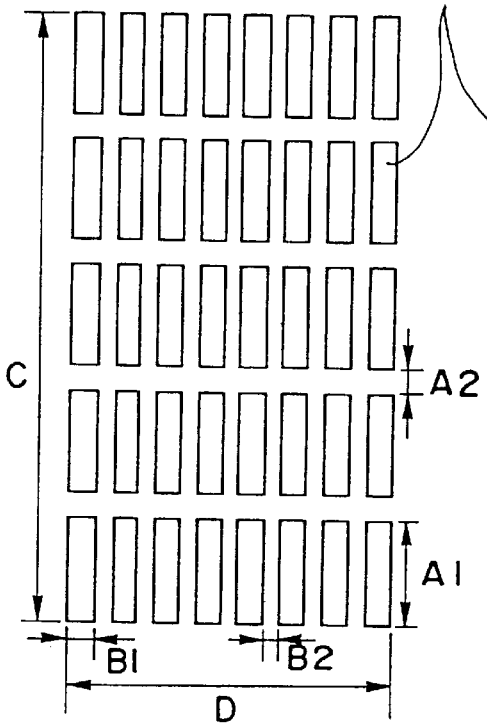
FIGS. 3A to 3D are diagrams illustrating examples of a configuration of the position detection marker which is formed on the multicolor heat-sensitive recording sheet in accordance with the present embodiment.

The position detection marker shown in FIG. 3A is formed by arranging a plurality of cut portions 11 in a lattice wherein the length of the entire portion of the position detection marker 18 is C, the width thereof is D, the length of a portion to be cut (a cut portion) is A1, the width thereof is B1, a longitudinal distance between cut portions is A2, and a widthwise distance between the cut portions is B2.

Figure 3B:
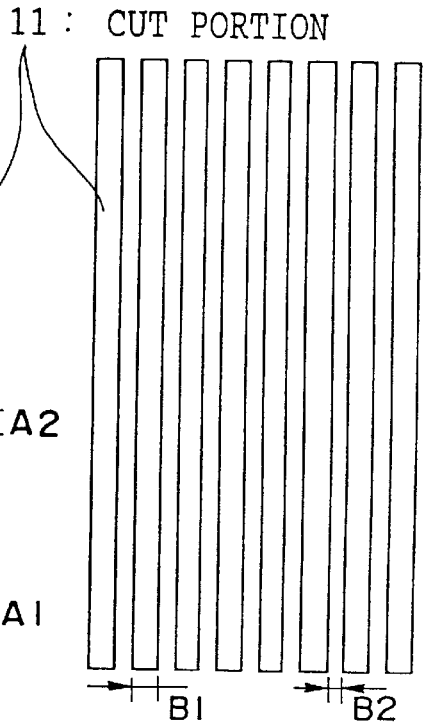
Figure 3C:
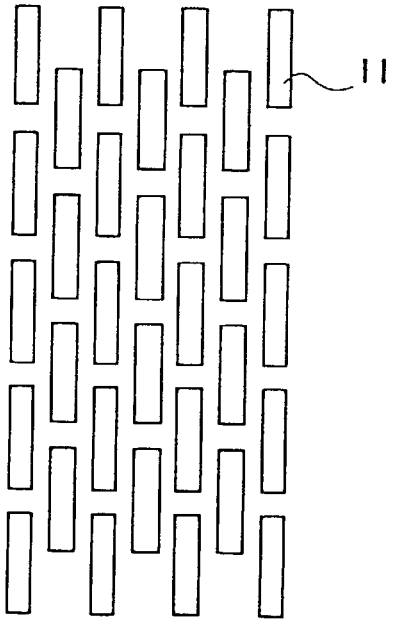
Figure 3D:
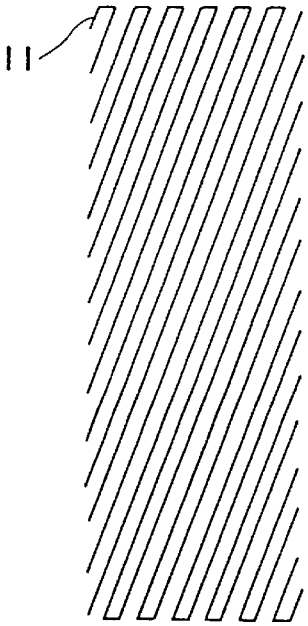

The position detection marker 18 of FIG. 3B is formed by arranging a plurality of the elongated cut portions 11 each having a width of B1 parallel to each other. The position detection marker 18 of FIG. 3C is formed by arranging a plurality of the cut portions 11 each having the same size as that of FIG. 3A in a staggered form. The position detection marker 18 of FIG. 3D is formed by diagonally cutting the cut portions 11 each of which one end portion is not cut.

The position detection markers 18 in FIGS. 3A to 3C can be formed by being cut partially in the same manner as the image printing regions 16*a* to 16*d*.

The position detection marker 18 is cut at a position where a positional relationship between the image printing regions 16*a* to 16*d* and the position detection marker 18 is determined relatively to one another, and besides, the position detection marker 18 is able to change at least one of the configuration, the size, the number, and the position of a cut portion so as to correspond to the type of the image printing medium or the number of the image printing area, and display those information.

Figure 2A:
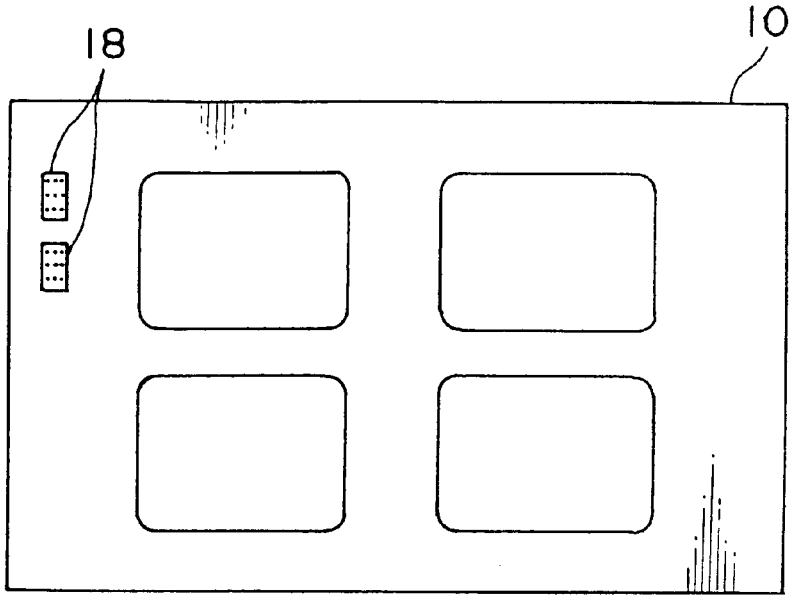
FIGS. 2A and 2B are plan views illustrating examples in which information about the number of image printing regions is represented by the number of position detection markers formed on the multicolor heat-sensitive recording sheet in accordance with the present embodiment.
Figure 2B:
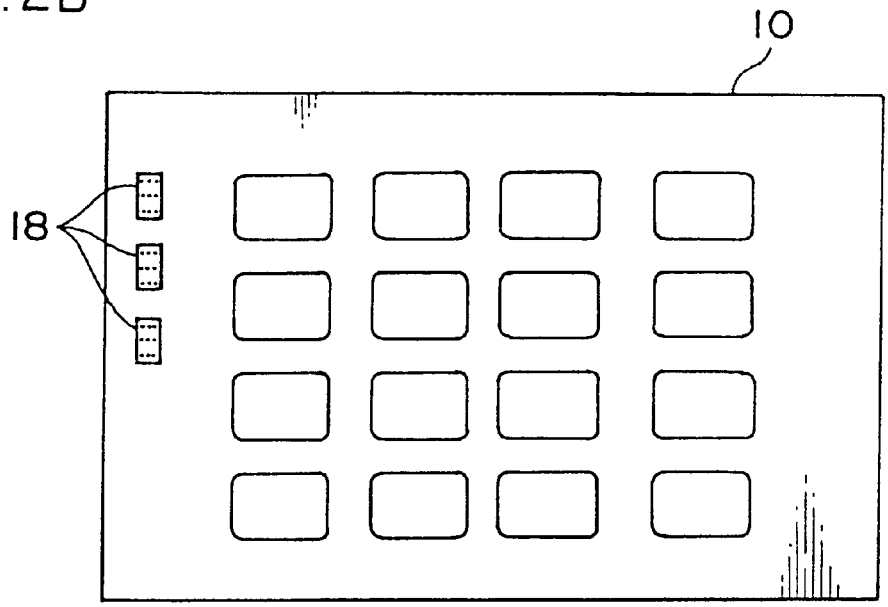

For example, as is shown in FIG. 2A, in a case in which two position detection markers 18 which are the same are provided, this is to imply that the image printing medium is divided into four image printing regions. As is shown in FIG. 2B, in a case in which three position detection markers 18 which are the same are provided, this is to imply that the image printing medium is divided into sixteen image printing regions. Further, at least one of the configuration, the size, the number, and the position of the cut portion can be changed in accordance with the type of the image printing medium, or the type and the number of the image printing region.

Next, a method for forming the position detection marker 18 on the multicolor heat-sensitive recording sheet 10 will be explained.

Figure 4A:
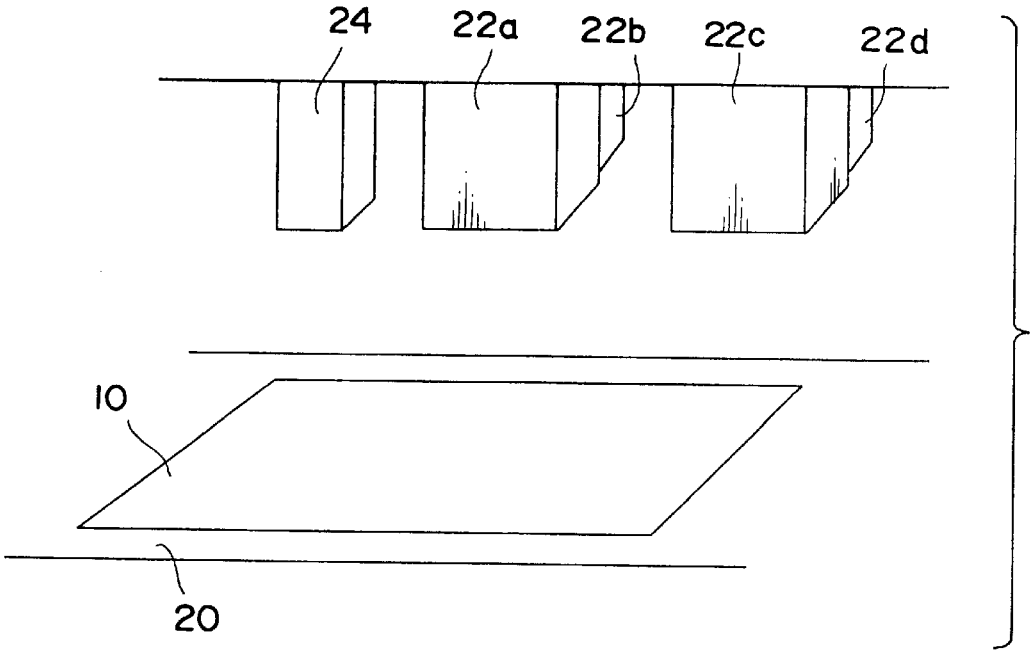
FIGS. 4A and 4B are schematic explanatory views illustrating a method of forming the position detection marker in accordance with the present embodiment.

As is shown in FIG. 4A, the multicolor heat-sensitive recording sheet 10 in which the seal 12 and the peel-off paper 14 are adhered to each other is placed on a cutting platform 20.

Cutters 22*a*, 22*b*, 22*c*, and 22*d* for cutting the image printing regions 16*a*, 16*b*, 16*c*, and 16*d* (see FIG. 1), and a cutter 24 for cutting the position detection marker 18 are mounted above the cutting platform 20 so as to correspond to respective positions of the multicolor heat-sensitive recording sheet 10 at which the image printing regions 16 are formed.

The blades of the cutters 22*a* to 22*d*, and the image printing regions 16*a* to 16*d* are formed into the same rectangular configuration. The cutter 24 and the position detection marker 18 are formed into the same configuration. The inside of the cutter 24 is formed by a blade shape so as to correspond to a perforation of the position detection marker 18.

Figure 4B:
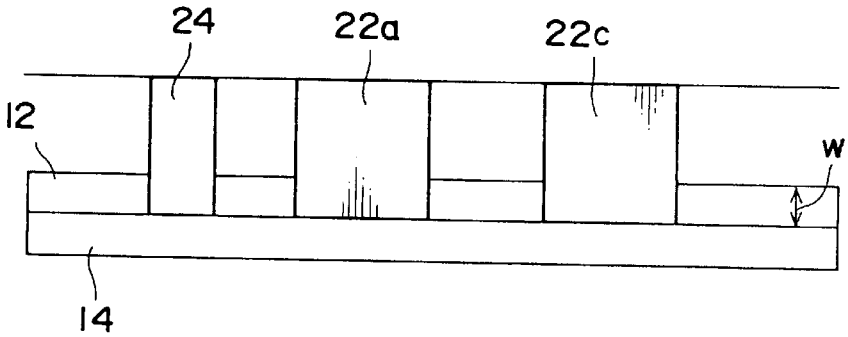

As is shown in FIG. 4B, the cutters 22*a* to 22*d*, and the cutter 24 are vertically lowered to the multicolor heat-sensitive recording sheet 10. The seal 12 is cut by a thickness W. After the cutting of the seal 12 has been completed, the cutters 22*a* to 22*d*, and the cutter 24 are lifted to their original positions. In this way, cuts are formed on the multicolor heat-sensitive recording sheet 10.

As described above, in accordance with the present embodiment, the position detection marker 18 can be formed at the same time when the image printing regions 16 is formed by cutting. Accordingly, as compared to a method of printing a position detection marker, a printing process other than a cutting process becomes unnecessary, and the position detection marker can be marked more simply.

Further, since the position detection marker 18 can be formed by a method in which only the seal 12 is cut so as not to penetrate the peel-off paper 14, as compared to a method of forming the position detection marker 18 by punching the multicolor heat-sensitive recording sheet, generation of waste can be prevented, and taking measures for preventing waste during the cutting process becomes unnecessary. Moreover, since holes are not punched in the multicolor heat-sensitive recording sheet 10, even in a case of the multicolor heat-sensitive recording sheet 10 in a roll, there is not caused such a problem that portions of the multicolor heat-sensitive recording sheet 10 overlapping the punched holes therein are exposed to light.

A description of a thermal printer using the multicolor heat-sensitive recording sheet 10 in accordance with the present invention will be given hereinafter.

Figure 5:
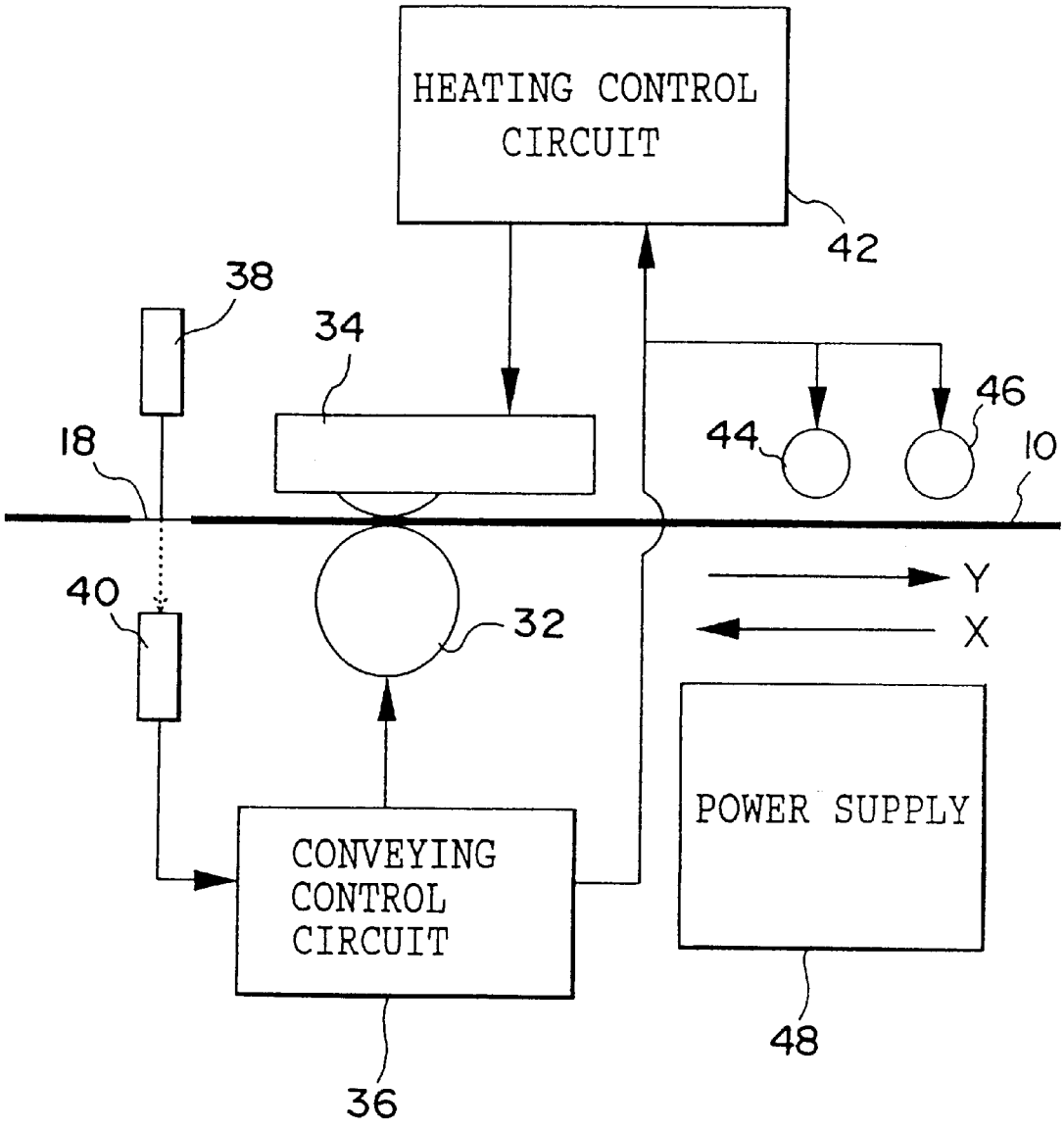
FIG. 5 is a schematic explanatory view illustrating a method of detecting the position detection marker which is formed on the multicolor heat-sensitive recording sheet in accordance with the present embodiment.

As is shown in FIG. 5, in the thermal printer, from a downstream side of a conveying path on which the multicolor heat-sensitive recording sheet 10 is conveyed, there are sequentially provided a light emitting device 38, a thermal head 34, a fixing lamp 44, a fixing lamp 46, and a heating control circuit 42 at the upper side of the conveying path, a light receiving device 40, a platen roller 32, and a conveying control circuit 36 at the lower side of the conveying path, so as to interpose the multicolor heat-sensitive recording sheet 10 when conveyed.

With respect to the multicolor heat-sensitive recording sheet 10, the light emitting device 38 is provided at the upper side and the light receiving device 40 is provided at the lower side so as to correspond to the light emitting device 38. The thermal head 34 is provided at the upper side and the platen roller 32 is provided at the lower side so as to correspond to the thermal head 34.

The conveying control circuit 36 is connected to the platen roller 32, the light receiving device 40 of a marker detection sensor which comprises the light emitting device 38 and the light receiving device 40, the fixing lamp 44, the fixing lamp 46, and the heating control circuit 42. The heating control circuit 42 is connected to the conveying control circuit 36 and the thermal head 34. Further, a reference number 48 is a power supply.

While being conveyed by an unillustrated pair of conveying rollers in a direction of an arrow X, the multicolor heat-sensitive recording sheet 10 is illuminated by the light emitting device 38, and the light transmitted through the multicolor heat-sensitive recording sheet 10 is received by the light receiving device 40.

When the position detection marker 18 formed on the multicolor heat-sensitive recording sheet 10 reaches a position at which the light emitting device 38 illuminates, transmittance of the light transmitted and the amount of light detected by the light receiving device 40 changes by a predetermined amount. By the difference between transmittances, the position detection marker 18 can be detected.

Image data is read from an unillustrated image memory, and the image data read is made to be synchronized with when the position detection marker 18 is detected. Accordingly, while the multicolor heat-sensitive recording sheet 10 is conveyed in the direction of the arrow X, a Y (yellow) color-forming layer is color-formed line by line on the image printing area by using the thermal head 34. After the Y color-forming layer for one image screen has been color-formed, the multicolor heat-sensitive recording sheet 10 is conveyed in a reverse direction (in a direction of Y) so as to fix Y-color by the fixing lamp 44 for the Y-color.

Next, the multicolor heat-sensitive recording sheet 10 is conveyed again in the direction of the arrow X, and the same processes are applied to the following color-formation and fixation of an M color-forming layer or a C color-forming layer.

The above-described position detection marker 18 has been detected by using a transmission optical sensor. However, the detection of the position detection marker 18 can be carried out by using a reflection optical sensor.

Figure 6:
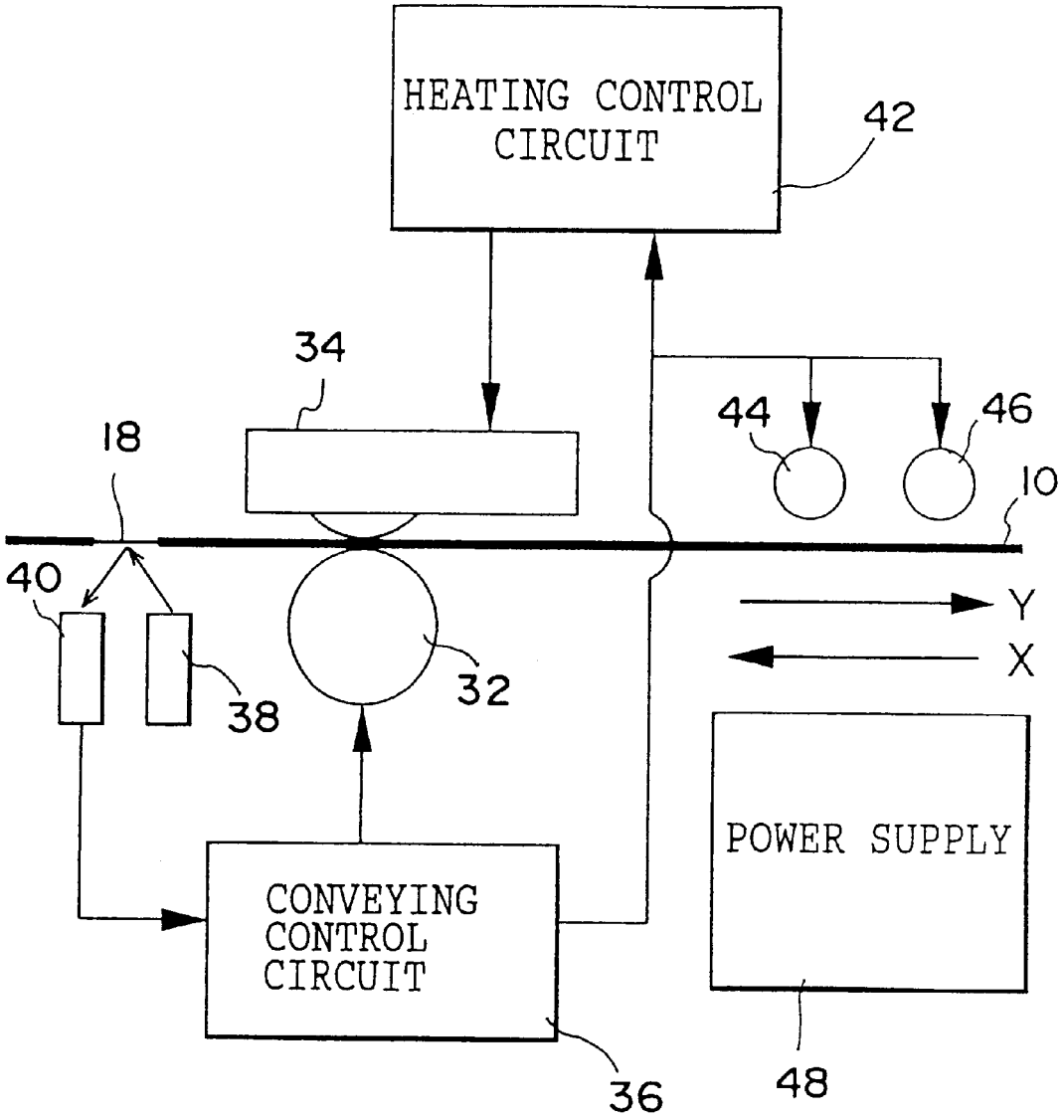
FIG. 6 is a schematic explanatory view illustrating another method of detecting the position detection marker which is formed on the multicolor heat-sensitive recording sheet in accordance with the present embodiment.
Figure 7A:
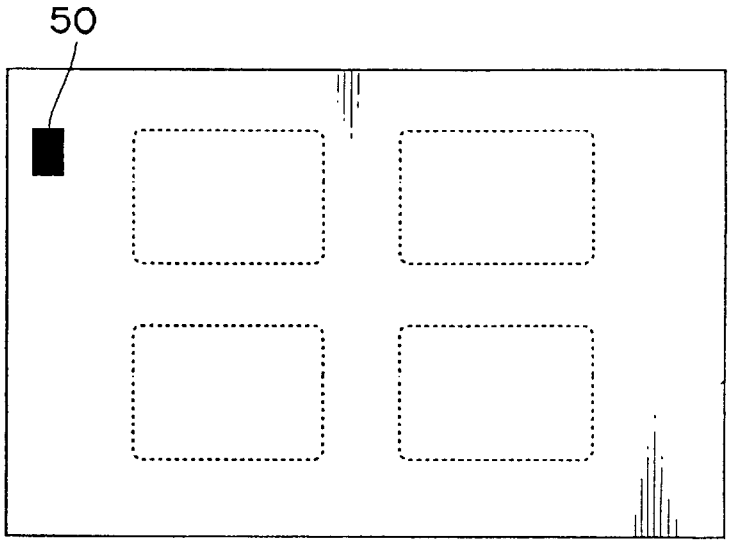
FIG.7A PRIOR ART
FIGS. 7A and 7B are examples of conventional position detection markers.
Figure 7B:
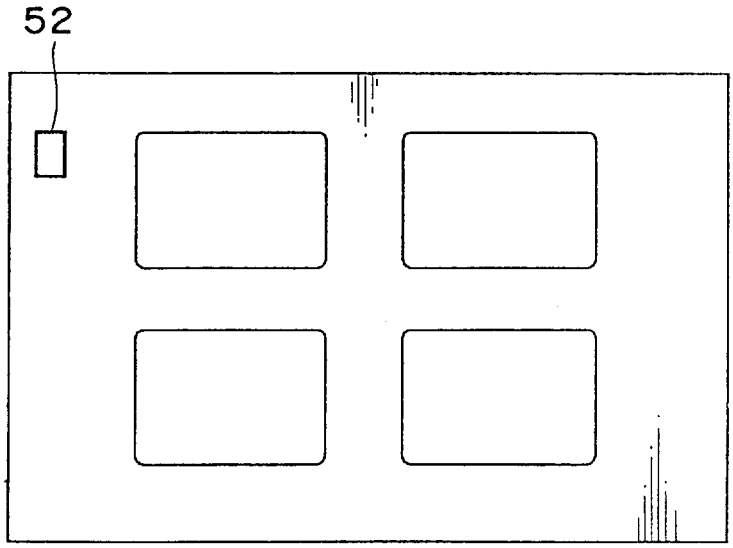
FIG.7B PRIOR ART

Namely, as is shown in FIG. 6, the light emitting device 38 and the light receiving device 40 are located at one side of the conveying path of the multicolor heat-sensitive recording sheet 10 so that the multicolor heat-sensitive recording sheet 10 is illuminated by the light emitting device 38, and light reflected from the multicolor heat-sensitive recording sheet 10 is received by the light receiving device 40. When the position detection marker 18 formed on the multicolor heat-sensitive recording sheet 10 reaches a position at which the light emitting device 38 illuminates, reflectance of light changes, the amount of light detected by the light receiving device 40 changes by a predetermined amount, and the position detection marker 18 can be detected.

Stripes of a striped cutting pattern (i.e., a longitudinal direction of the cut portion) that forms the position detection marker 18 are formed in a direction parallel to the conveying direction of the multicolor heat-sensitive recording sheet 10. Accordingly, the length of the cut portion in the conveying direction of the multicolor heat-sensitive recording sheet 10 during image printing is made longer so that peeling-off of the cut portion due to friction with the thermal head can be prevented.

For example, when the position detection marker 18 has a configuration which is shown in FIG. 3A, the length A1 of each of the cut portions becomes larger than the width B1 thereof. Accordingly, during image printing, if this position detection marker 18 is conveyed in a longitudinal direction thereof, peeling-off of the cut portion from the multicolor heat-sensitive recording sheet 10 can be prevented.

In the above-description, an example in which the present invention is applied to an image printing medium such as a cut sheet has been explained. However, the present invention can be applied to a roll paper, or a paper having a format, such as a post card.

As described above, in accordance with the present invention, since the position detection marker is formed by cutting, it is possible to provide an image printing medium having a position detection marker which does not need to be printed during a manufacturing process and which does not result in the generation of waste.

What is claimed is:

1. An image printing medium, comprising:

(a) at least one image printing region; and (b) at least one position detection marker for use in detecting a position of the image printing region relative to the position detection marker, wherein said position detection marker is formed by cutting such that said position detection marker does not form a through hole in the image printing medium.

2. The image printing medium of claim 1, wherein said image printing region is formed by cutting.

3. The image printing medium of claim 2, wherein said position detection marker is formed when said image printing region is formed.

4. The image printing medium of claim 1, further comprising a sheet member having at least one surface with paper removably adhered to the surface.

5. The image printing medium of claim 4, wherein the sheet member includes another surface opposing said at least one surface, and the image printing region is formed by cutting said another surface to a depth no greater than to said paper.

6. The image printing medium of claim 4, wherein the sheet member includes another surface opposing said at least one surface, and the position detection marker is formed by partially cutting said another surface to a depth no greater than to said paper.

7. The image printing medium of claim 1, wherein the image printing medium is of different types, and the position detection marker includes information indicating at least one of information selected from the group consisting of the type of image printing medium and quantity of image printing regions.

8. The image printing medium of claim 7, wherein the position detection marker has a configuration that differs in accordance with at least one information selected from the group consisting of the type of image printing medium and quantity of image printing regions.

9. The image printing medium of claim 7, wherein the position detection marker has a size that differs in accordance with at least one information selected from the group consisting of the type of image printing medium and quantity of image printing regions.

10. The image printing medium of claim 7, wherein a variable number of position detection markers are formed, said number being in accordance with at least one information selected from the group consisting of the type of image printing medium and quantity of image printing regions.

11. The image printing medium of claim 7, wherein the position detection marker is formed at a variable location, said location being in accordance with at least one information selected from the group consisting of the type of image printing medium and quantity of image printing regions.

12. The image printing medium of claim 1, wherein the image printing medium is for conveying in a predefined orientation along a conveying direction in a printer, and the position detection marker is cut substantially parallel to said conveying direction.

13. A multicolor heat-sensitive recording sheet comprising:

(a) at least one image printing region; and (b) at least one position detection marker for use in detecting a position of the image printing region relative to the position detection marker, wherein said position detection marker is formed by cutting such that said position detection marker does not form a through hole in the multicolor heat-sensitive recording sheet.

14. The multicolor heat-sensitive recording sheet of claim 13, wherein said image printing region is formed by cutting.

15. The multicolor heat-sensitive recording sheet of claim 14, wherein said position detection marker is formed when said image printing region is formed.

16. The multicolor heat-sensitive recording sheet of claim 13, further comprising a sheet member having at least one surface with paper removably adhered to the surface.

17. The multicolor heat-sensitive recording sheet of claim 13, wherein the sheet is for conveying in a predefined orientation along a conveying direction in a printer and the position detection marker is cut substantially parallel to said conveying direction.

18. A printer for printing an image on an image printing medium, the image printing medium having an image printing region and a position detection marker for detecting a position of the image printing region relative to the position detection marker, the image printing region and position detection marker being defined by cuts, the printer comprising:

(a) a sensor which detects the position detection marker on the image printing medium, the position detection marker, which is defined by the cuts, does not form a through hole in the image printing medium; and (b) an image printing member which prints an image on the image printing region at a time synchronized with when the position marker is detected, wherein the image printing medium is conveyed to the image printing member for printing an image on the image printing medium.

19. The printer of claim 18, wherein the sensor is an optical sensor in which detection is carried out based on a difference between light surface reflectances.

20. The printer of claim 18, wherein the sensor is an optical sensor, which detects the position detection marker based on a difference between light transmittances.

21. An image printing medium, comprising:

(a) at least one image printing region; and (b) at least one position detection marker for use in detecting a position of said image printing region relative to said position detection marker, wherein said position detection marker is formed by cutting, and said image printing region is formed by cutting, and wherein said position detection marker is formed when said image printing region is formed.

22. An image printing medium, comprising:

(a) at least one image printing region;

(b) at least one position detection marker for use in detecting a position of said image printing region relative to said position detection marker, wherein said position detection marker is formed by cutting; and (c) a sheet member having at least one surface with paper removably adhered to the surface, wherein the sheet member includes another surface opposing said at least one surface, and the position detection marker is formed by partially cutting said another surface to a depth no greater than to said paper.

23. An image printing medium, comprising:

(a) at least one image printing region; and (b) at least one position detection marker for use in detecting a position of said image printing region relative to said position detection marker, wherein said position detection marker is formed by cutting, and wherein the image printing medium is of different types, and said position detection marker includes information indicating at least one of information selected from the group consisting of the type of image printing medium and quantity of image printing regions.

24. The image printing medium of claim 23, wherein said position detection marker has a configuration that differs in accordance with at least one information selected from the group consisting of the type of image printing medium and quantity of image printing regions.

25. The image printing medium of claim 23, wherein said position detection marker has a size that differs in accordance with at least one information selected from the group consisting of the type of image printing medium and quantity of image printing regions.

26. The image printing medium of claim 23, wherein a variable number of position detection markers are formed, said number being in accordance with at least one information selected from the group consisting of the type of image printing medium and quantity of image printing regions.

27. The image printing medium of claim 23, wherein said position detection marker is formed at a variable location, said location being in accordance with at least one information selected from the group consisting of the type of image printing medium and quantity of image printing regions.

28. A multicolor heat-sensitive recording sheet comprising:

(a) at least one image printing region; and (b) at least one position detection marker for use in detecting a position of said image printing region relative to said position detection marker, wherein said position detection marker is formed by cutting, and said image printing region is formed by cutting, and wherein said position detection marker is formed when said image printing region is formed.

* * * * *